US005160892A

United States Patent [19]

Makhija et al.

[11] Patent Number: 5,160,892

[45] Date of Patent: Nov. 3, 1992

[54] ENGINE ANALYZER WAVEFORM DISPLAY WITH A BUFFER REGION

[75] Inventors: Surender K. Makhija, Brookfield; Steven J. Sparacino, Greenfield; Robert T. Burgess, West Allis, all of Wis.

[73] Assignee: Bear Automotive Service Equipment Company, New Berlin, Wis.

[21] Appl. No.: 593,154

[22] Filed: Oct. 5, 1990

[51] Int. Cl.[5] ..... F02P 17/00

[52] U.S. Cl. ..... 324/379; 324/384; 364/424.03; 364/431.03; 73/117.3

[58] Field of Search ..... 324/378, 379, 384; 364/424.03, 424.04, 431.03, 551.01; 73/117.3

[56] References Cited

U.S. PATENT DOCUMENTS

| | | | |
|---|---|---|---|
| 4,188,618 | 2/1980 | Weisbart | 364/424.04 |
| 4,251,774 | 2/1981 | Knödler | 324/384 |
| 4,399,407 | 8/1983 | Kling et al. | 324/379 |
| 4,425,791 | 1/1984 | Kling | 73/117.3 |
| 4,472,779 | 9/1984 | Marino et al. | 364/431.01 |
| 4,476,531 | 10/1984 | Marino et al. | 364/431.01 |
| 4,800,378 | 1/1989 | Putrow et al. | 324/379 X |
| 4,812,768 | 3/1989 | Quinn | 324/379 |
| 4,851,833 | 7/1989 | Govekar | 324/379 X |

*Primary Examiner*—Kenneth A. Wieder
*Assistant Examiner*—Glenn W. Brown
*Attorney, Agent, or Firm*—Kinney & Lange

[57] ABSTRACT

An engine analyzer for an internal combustion engine includes an analog-to-digital (A/D) converter which digitizes an analog input waveform representing, for example, a secondary or primary voltage waveform of the ignition coil of the internal combustion engine. The sampling rate of the analog digital converter is determined by dividing the waveform time period by the desired number of samples. An adjustment factor C is used to provide a buffer period during the sampling period of the waveform. A display for displaying the waveform has a buffer region which corresponds to the buffer period. Thus, a variation in the speed of the engine which causes the engine to slow down and extends the period of the engine waveform does not cause a loss of data collected from the waveform because the buffer period provides a margin of error.

22 Claims, 6 Drawing Sheets

ENGINE ANALYZER WAVEFORM DISPLAY WITH A BUFFER REGION

BACKGROUND OF THE INVENTION

The present invention relates to engine analyzer apparatus used for testing internal combustion engines. In particular, the invention relates to a waveform display for an engine analyzer apparatus.

One common type of engine analyzer apparatus used for testing an internal combustion engine employs a cathode ray tube having a display screen on which analog waveforms are displayed which are associated with operation of the engine. In a typical apparatus of this type, a substantial horizontal trace is produced on the screen of the cathode ray tube by applying a sawtooth ramp voltage between the horizontal deflection plates of the tube while the analog signal being measured is applied to the vertical deflection plates of the tube. The typical analog signals which are applied to the vertical plates of the cathode ray tube are the primary voltage which exists across the primary winding of the ignition coil, and a signal representative of the secondary voltage of the ignition coil. These voltages are affected by the condition of various elements of the ignition system of the engine, such as the spark plugs.

In the case of a multicylinder internal combustion engine, the primary and secondary voltage waveforms have typically been displayed on the cathode ray tube in one of two ways. In one case, the waveform being displayed represents a complete cycle of the engine, in which the conditions associated with the various cylinders are displayed sequentially in a predetermined pattern. This type of display has commonly been referred to as a "parade" pattern or display.

In the other common method of displaying waveforms, there are a plurality of horizontal traces, one above the other, with each trace being associated with the operation of one of the cylinders of the engine. The number of horizontal traces usually corresponds to the number of cylinders on the engine. This method of displaying waveforms has been referred to in the industry as a "raster" display.

With the advent of low cost microelectronic devices, and in particular microprocessors, digital electronic systems have found increasing use in a wide variety of applications. Digital electronic systems have many significant advantages over analog systems, including increased ability to analyze and store data, higher accuracy, greater flexibility in design and application, and the ability to interface with computers having larger and more sophisticated data processing and storage capabilities. In the past, it has been difficult to display the waveform for an engine if engine speed changed during the sampling period. For example, U.S. Pat. No. 4,399,407 issued to Kling et al. on Aug. 16, 1983 and entitled ENGINE ANALYZER WITH CONSTANT WIDTH DIGITAL WAVEFORM DISPLAY, incorporated herein by reference, is one such method in which the waveform of each cylinder is adjusted to have equal width when displayed.

Prior art display techniques have required two complete engine cycles for each display. During a first timing cycle, timing information is collected which is used to determine the sampling rate for each cylinder. Variation in the speed of the engine between the timing cycle and the data collection cycle could result in loss of data in the waveform of a cylinder.

A display technique in an engine analyzer system which displays the waveform for an entire firing cycle and which allows for comparison between time variations for cylinders of the engine would be a significant contribution to the art.

SUMMARY OF THE INVENTION

The present invention is an engine analyzer apparatus for an internal combustion engine in which waveforms representing operation of a system or component of an internal combustion engine are displayed. Analog electrical input waveforms are digitized by the system of the present invention, and the digitized input waveform is stored in the form of digital data. Digital control means, which preferably includes a programmed digital computer such as a microprocessor, selects digital data which has been stored. Display means displays a simulated visual representation of an analog waveform based upon the selected digital data.

In the present invention, engine waveforms are displayed for each cycle of the engine without altering the relative width of the waveforms between each cylinder of the engine. Furthermore, the present invention allows for variations in engine RPM without loss of waveform data. Using an initial RPM measurement, the sampling rate is determined by multiplying the desired number of samples per cylinder by the number of cylinders in the engine and dividing by the total time of each firing cycle of the engine. This number is then reduced by an adjustment factor, C, so that the total sampling period is extended. This provides a buffer period in the sampling period which has a corresponding buffer region in the display. In a preferred embodiment, the sampling period is extended by about ten percent. Thus, if a time of a firing of a cylinder is longer than expected, data is not lost at the end of the sampling period. Furthermore, the relative shape of the waveforms for each cylinder are not altered and can be compared with each other. This is useful as an additional diagnostic aide.

In the present invention, engine speed or RPM is measured. An analog-to-digital (A/D) converter means digitizes the input analog waveform by sampling the input waveform at a data sample rate and converting each of the samples to a digital value. The engine analyzer system of the present invention varies the data sample rate of the analog-to-digital converter means so that the number of data samples is sufficient to cover the waveform of the engine being measured. Furthermore, if the speed of the engine varies during the sampling period, and the engine slows down, in the present invention the additional information in the extended engine waveform is not lost. The digitized engine waveform information is displayed by a display means. The buffer period of the sampling period and the buffer region of the display ensure that the entire waveform is displayed.

The present invention provides a buffer region at the end of each sampling period. Thus, in the present invention if the time of an engine firing cycle lengthens during a sampling period, the additional data is not lost. In a preferred embodiment of the present invention, the engine analyzer uses a buffer period of ten percent of the expected length of an engine firing cycle. Furthermore, the present invention allows faster screen updates because each update does not require two complete engine cycles.

DETAILED DESCRIPTION OF THE PREFERRED EMBODIMENTS

Figure 1:
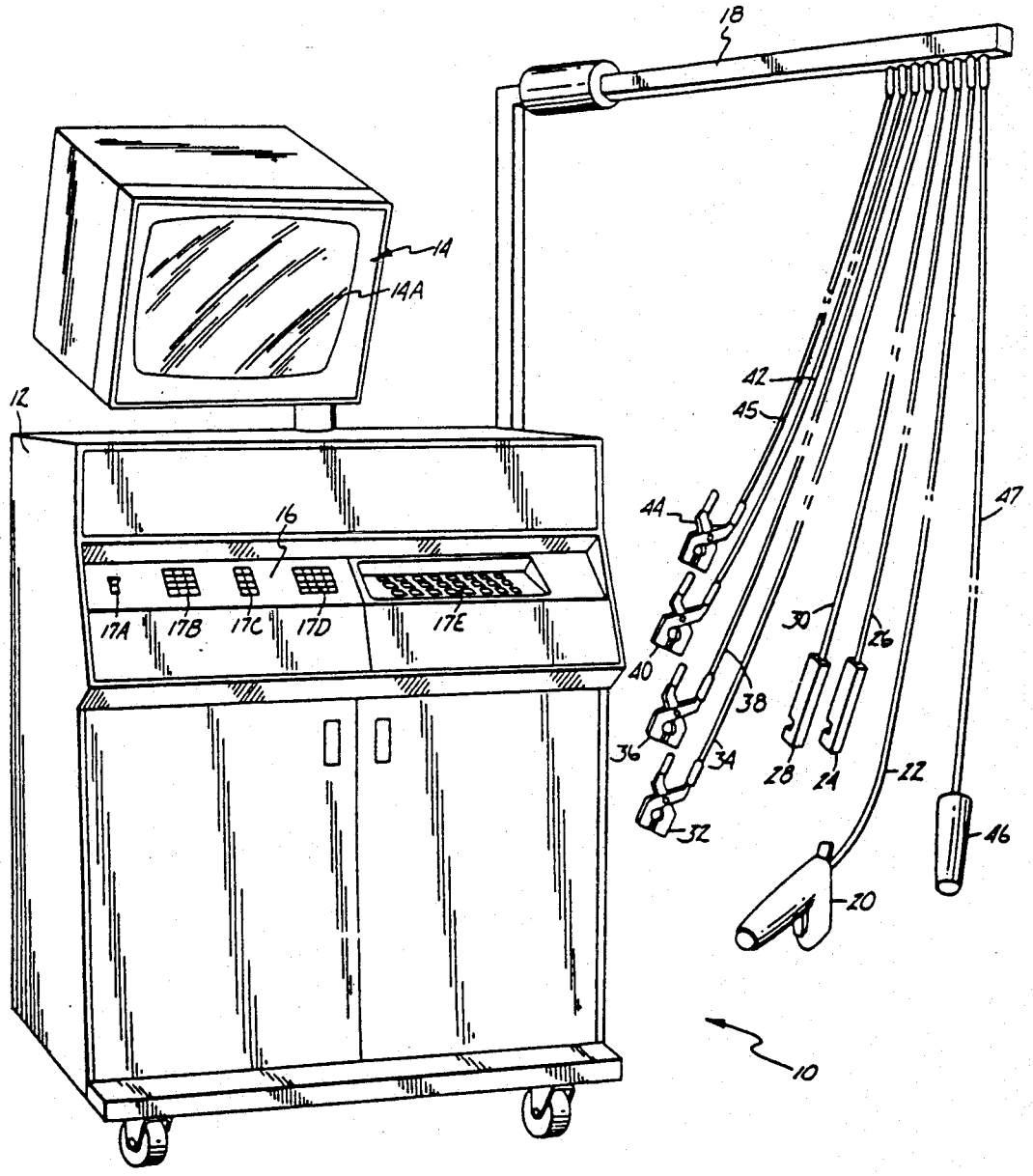
FIG. 1 is a perspective view showing an engine analyzer apparatus which utilizes the present invention.

In FIG. 1, engine analyzer 10 is shown. Mounted at the front of housing 12 of analyzer 10 are cathode ray tube (CRT) raster scan display !4 and user interface 16, which is preferably a control panel having a power switch 17A, three groups of control switches or keys 17B–17D, as well as a keyboard 17E for entering numerical information. Extending from boom 18 are a plurality of cables which are electrically connected to the circuitry within housing 12, and which are intended for use during operation of the analyzer 10. Timing light 20 is connected at the end of multiconductor cable 22. "High tension" (HT) probe 24 is connected at the end of multiconductor cable 26, and is used for sensing secondary voltage of the ignition system of an internal combustion engine of a vehicle (not shown). "No. 1" probe 28 is connected to the end of multiconductor cable 30, and is used to sense the electrical signal being supplied to the No. 1 sparkplug of the ignition system. "Engine Ground" connector 32, which is preferably an alligator-type clamp, is connected at the end of cable 34, and is typically connected to the ground terminal of the battery of the ignition system. "Points" connector 36, which is preferably an alligator-type clamp, is attached, to the end of cable 38 and is intended to be connected to one of the primary winding terminals of an ignition coil of the ignition system. "Coil" connector 40, which is preferably an alligator-type clamp attached to the end of cable 42, is intended to be connected to the other primary winding terminal of the ignition coil. "Battery" connector 44, which is preferably an alligator-type clamp, is attached to the end of cable 45. Battery connector 44 is connected to the "hot" or "non-ground" terminal of the battery of the ignition system. Vacuum transducer 46 at the end of multiconductor cable 47 produces an electrical signal which is a linear function of vacuum r pressure, such as input manifold vacuum or pressure.

In the present invention, electrical signals derived from probes 24 and 28, from connectors 32, 36, 40 and 44 and from vacuum transducer 46 are used to produce digitized waveforms which are stored as digital data in digital memory. Upon request by the user, through user interface 16, analyzer 10 of the present invention displays on display 14 waveforms derived from selected stored digital data. In the present invention, therefore, the waveforms displayed by raster scan display 14 are simulated representations of individual digitized waveforms which have previously been stored.

Figure 2:
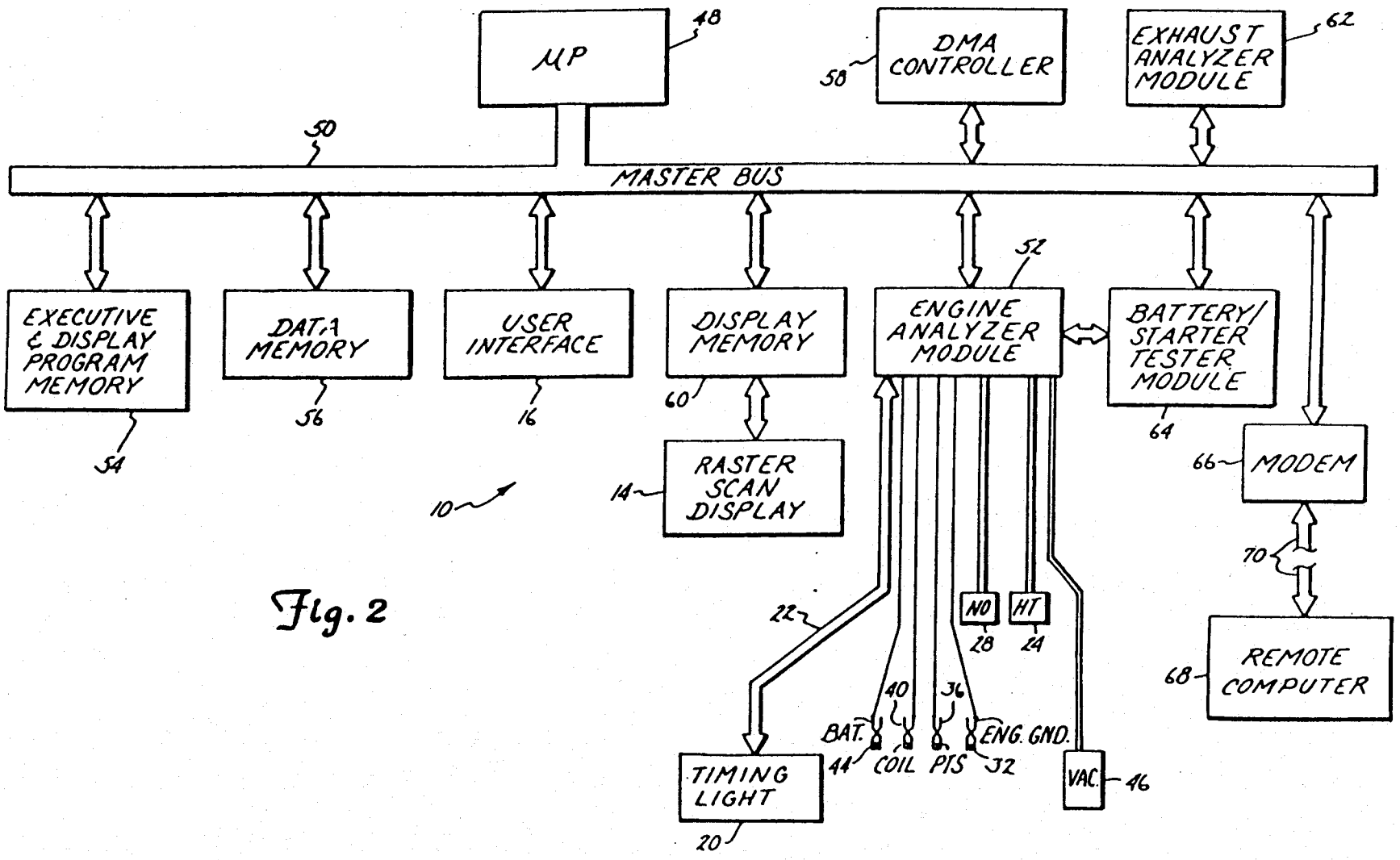
FIG. 2 is an electrical block diagram of the engine analyzer apparatus of FIG. 1.

FIG. 2 is an electrical block diagram showing engine analyzer 10 of the present invention. Operation of engine analyzer 10 is controlled by microprocessor 48, which communicates with the various subsystems of engine analyzer 10 by means of master bus 58. In the preferred embodiments of the present invention, master bus 50 is made up of fifty-six lines, which form a data bus, an address bus, a control bus, and a power bus.

Timing light 20, HT probe 24, No. 1 probe 28, Engine Ground connector 32, Points connector 36, Coil connector 40, Battery connector 44, and vacuum transducer 46 interface with the electrical system of engine analyzer 10 through engine analyzer module 52. Engine analyzer module 52 includes a digital section 52B and an analog section 52B. Input signal processing is performed in the analog section, and the input analog waveforms received are converted to digitized waveforms in the form of digital data. The digital section of engine analyzer module 52 interfaces with master bus 50.

Control of the engine analyzer system 10 by microprocessor 48 is based upon a stored program in engine analyzer module 52 and a stored program in executive and display program memory 54 (which interfaces with master bus 50). Digitized waveforms produced, for example, by engine analyzer module 52 are stored in data memory 56. The transfer of digitized waveforms from engine analyzer module 52 to data memory 56 is provided by direct memory access (DMA) controller 58. When engine analyzer module 52 provides a DMA Request signal on master bus 50, DMA controller 58 takes control of master bus 50 and transfers the digitized waveform data from engine analyzer module 52 directly to data memory 56. As soon as the data has been transferred, DMA controller 58 permits microprocessor 48 to again take control of master bus 50. As a result, the system of the present invention, as shown in FIG. 2, achieves storage of digitized waveforms in data memory 56 without requiring an inordinate amount of time of microprocessor 48 to accomplish the data transfer.

User interface 16 interfaces with master bus 50 and permits the operator to enter data and select particular tests or particular waveforms to be displayed. When the operator selects a particular waveform by means of user interface 16, microprocessor 38 retrieves the stored digitized waveform from data memory 56, converts the digitized waveform into the necessary digital display data to reproduce the waveform on raster scan display 14, and transfers that digital display data to display memory 60. As long as the digital display data is retained by display memory 60, raster scan display 14 continues to display the same waveform.

Display memory 60 contains one bit for each picture element (pixel) that can be displayed on raster scan display 14. Each bit corresponds to a dot on the screen of raster scan display 14. In preferred embodiments of the present invention, the digitized waveform stored in data memory 56 represents individually sampled points on the waveform. Executive and display program memory 54 includes a stored display program which permits microprocessor 48 to "connect the dots" represented by the individual sampled points of the digitized waveform, so that the waveform displayed by raster scan display 14 is a reconstructed simulated waveform which has the appearance of a continuous analog waveform, rather than simply a series of individual dots. Microprocessor 48 determines the coordinates of the dot representing one digitized sampled point on the digitized waveform, determines the coordinates of the next dot, and then fills in the space between the two dots with additional intermediate dots to give the appearance of a continuous waveform. The digital display data stored in display memory 60, therefore, includes bits corresponding to the individual sampled points on the waveform which had been stored by data memory 56, plus bits corresponding to the intermediate dots between these individual sampled points.

As further illustrated in FIG. 2, engine analyzer 10 has the capability of expansion to perform other engine test functions by adding other test modules. These modules can include, for example, exhaust analyzer module 62 and battery/starter tester module 64. Both modules 62 and 64 interface with the remaining system of analyzer 10 through master bus 50 and provide digital data or digitized waveforms based upon the particular tests performed by those modules. In the preferred embodiments shown in FIG. 2, modulator/demodulator (MODEM) 66 also interfaces with master bus 50, to permit analyzer 10 to interface with remote computer 68 through communication link 70. Modem 66 permits digitized waveforms stored in data memory 56 to be transferred to remote computer 68 for further analysis, and also allows remote computer 68 to provide test parameters and other control information to microprocessor 48 for use in testing.

Figure 3:
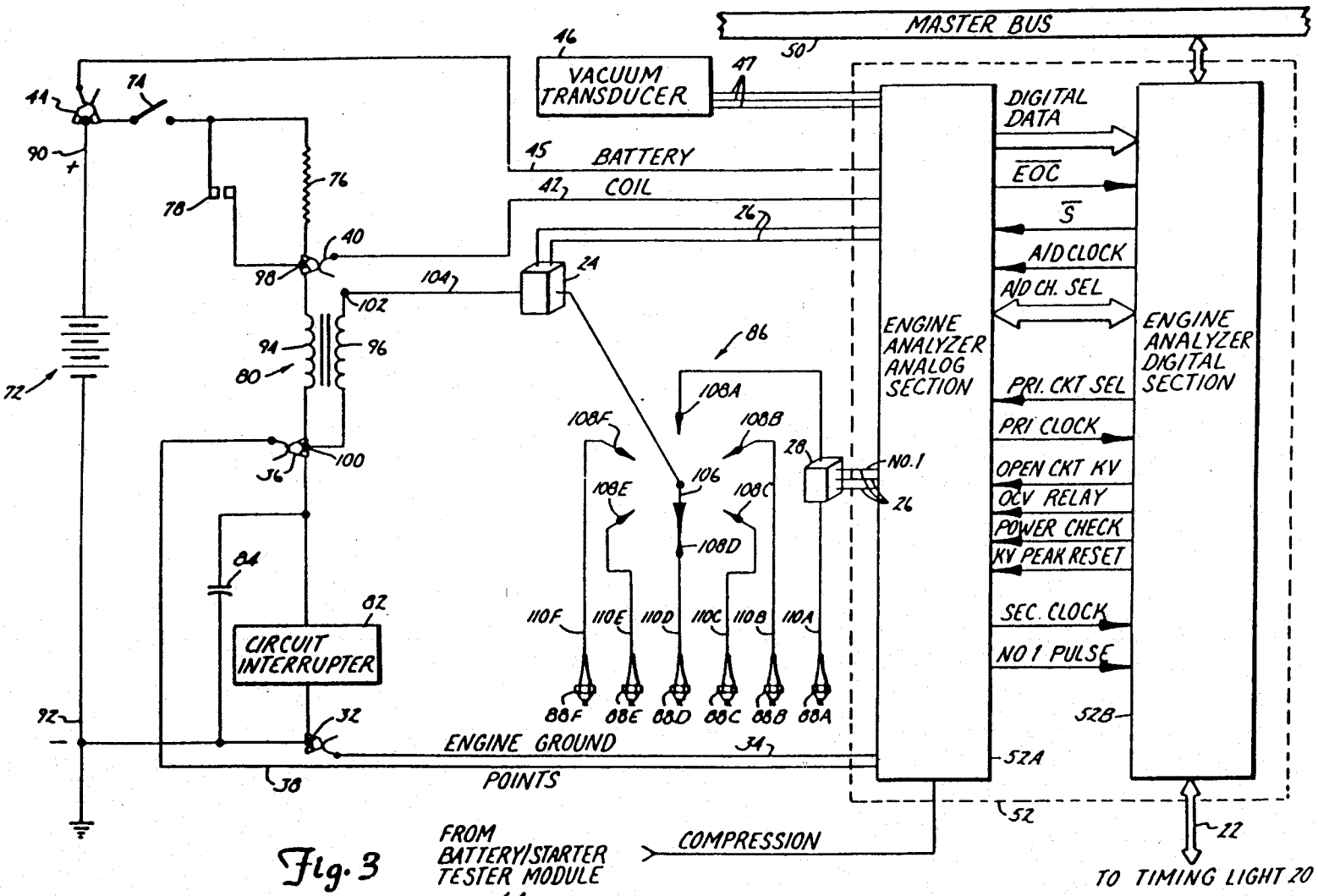
FIG. 3 shows the engine analyzer module of the apparatus of FIG. 2 in electrical schematic form in connection with a conventional ignition system of n internal combustion engine.

FIG. 3 shows engine analyzer 52 connected to a vehicle ignition system, which is schematically illustrated. The ignition system includes battery 72, ignition switch 74, ballast resistor 76, relay contacts 78, ignition coil 80, circuit interrupter 82, condenser 84, distributor 86, and igniters 88A–88F. The particular ignition system shown in FIG. 3 is for a six-cylinder internal combustion engine. Engine analyzer 10 of the present invention may be used with a wide variety of different engines which have different numbers of cylinders. The six-cylinder ignition system shown in FIG. 3 is strictly for the purpose of example.

In FIG. 3, battery 72 has its positive (+) terminal 90 connected to one terminal of ignition switch 74, and its negative (−) terminal 92 connected to engine ground. Ignition switch 74 is connected in a series current path with ballast resistor 76, primary winding 94 of ignition coil 80, and circuit interrupter 82 between positive terminal 90 and engine ground (i.e. negative terminal 92). Relay contacts 78 are connected in parallel with ballast resistor 76, and are normally open during operation of the engine. Relay contacts 78 are closed during starting of the engine by a relay coil associated with the starter/cranking system (not shown) so as to short out ballast resistor 76 and thus reduce resistance in the series current path during starting of the engine.

Condenser 84 is connected in parallel with circuit interrupter 82, and is the conventional capacitor used in ignition system. Circuit interrupter 82 is, for example, conventional breaker points operated by a cam associated with distributor 86, or is a solid state switching element in the case of solid state ignition systems now available in various automobiles.

As shown in FIG. 3, ignition coil 80 has three terminals 98, 100, and 102. Low voltage primary winding 94 is connected between terminals 98 and 100. Terminal 98 is connected to ballast resistor 76, while terminal 100 is connected to circuit interrupter 82. High voltage secondary winding 96 of ignition coil 80 is connected between terminal 100 and terminal 102. High tension wire 104 connects terminal 102 of coil 80 to distributor arm 106 of distributor 86. Distributor arm 106 is driven by the engine and sequentially makes contact with terminals 108A–108F of distributor 86. Wires connect terminals 108A–108F with igniters 88A–88F, respectively. Igniters 88A–88F normally take the form of conventional spark plugs. While igniters 88A–88F are shown in FIG. 3 as located in a continuous row, it will be understood that they are associated with the cylinders of the engine in such a manner as to produce the desired firing sequence. Upon rotation of distributor arm 106, voltage induced in secondary winding 96 of ignition coil 80 is successively applied to the various igniters 88A–88F in desired firing sequence.

As shown in FIG. 3, engine analyzer 10 interfaces with the engine ignition system through engine analyzer module 52, which includes engine analyzer analog section 52A and engine analyzer digital section 52B. Input signals are derived from the ignition system by means of Engine Ground connector 32, Points connector 36, coil connector 40, Battery connector 44, HT secondary voltage probe 24, and No. 1 probe 28. In addition, a vacuum/pressure electrical input signal is produced by vacuum transducer 46, and a COMPRESSION input signal (derived from starter current) is produced by battery/starter tester module 64. These input signals are received by engine analyzer analog section 52A and are converted to digital signals which are then supplied to engine analyzer digital section 52B. Communication between engine analyzer module 52 and microprocessor 48, data memory 56, and DMA controller 58 is provided by engine analyzer digital section 52B through master bus 50. In addition, engine analyzer digital section 52B interfaces with timing light 20 through cable 22.

As illustrated in FIG. 3, Engine Ground connector 32 is connected to negative terminal 92 of battery 72, or other suitable ground on the engine. Points connector 36 is connected to terminal 100 of ignition coil 80, which in turn is connected to circuit interrupter 82. As discussed previously, circuit interrupter 82 may be conventional breaker points or a solid state switching device of a solid state ignition system. Coil connector 40 is connected to terminal 98 of coil ignition 80, and Battery connector 44 is connected to positive terminal 90 of battery 72. All four connectors 32, 36, 40 and 44 are, therefore, connected to readily accessible terminals of the ignition system, and do not require removal of conductors in order to make connections to the ignition system.

HT probe 24 is a conventional probe used to sense secondary voltage by sensing current flow through conductor 104. Similarly, No. 1 probe 28 is a conventional probe used to sense current flow through wire 110A. In the example shown in FIG. 3, igniter 88A has been designated as the igniter for the "No. 1" cylinder of the engine. Both probe 24 and probe 28 merely clamp around existing conductors, and thus do not require removal of conductors in order to make measurements.

Figure 4:
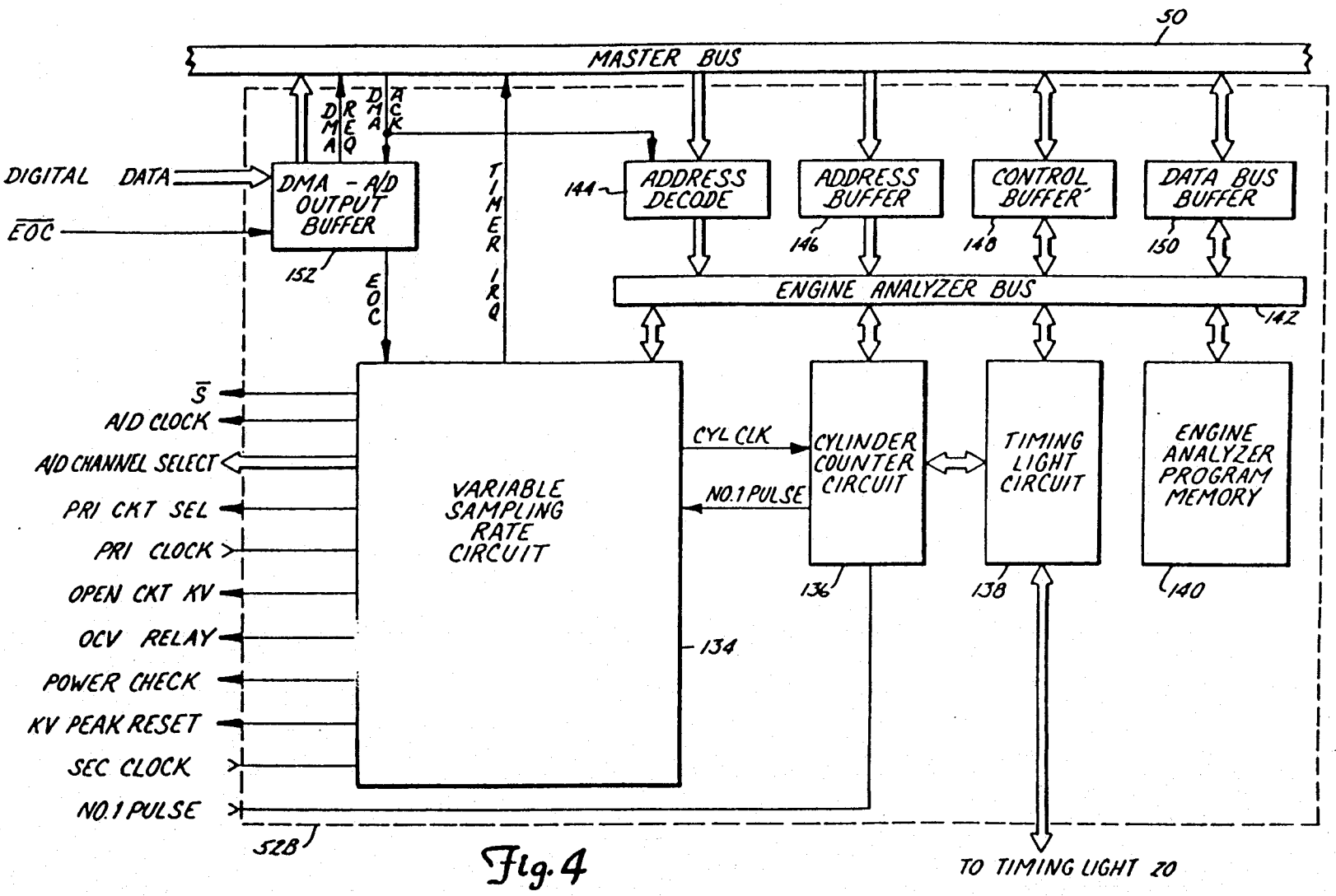
FIG. 4 i an electrical block diagram of the digital section of the engine analyzer of FIG. 3.

FIG. 4 is an electrical block diagram of digital section 52B of engine analyzer module 52. Digital section 52B includes variable sampling rate circuit 134, cylinder counter circuit 136, timing light circuit 138 and engine analyzer program memory 140, all of which are connected to engine analyzer bus 142. In preferred embodiments of the present invention, engine analyzer bus 142 includes digital data lines, address lines and control lines. Interface between digital section 52B and the remaining circuitry of engine analyzer 10 is provided by means of master bus 50. Address decode circuit 144, address buffer circuit 146, control buffer circuit 148, data bus buffer circuit 150, and DMA-A/D output buffer circuit 152 provide an interface between master bus 50 and the remaining circuitry of digital section 52B.

Variable sampling rate circuit 134 receives the PRI CLOCK and SEC CLOCK signals from analog section 52A, and provides the various control signals to analog section 52A which determine the particular test being performed and the particular digital data which is received from analog section 52A. These control signals include the $\overline{S}$ and A/D CLOCK signals supplied to A/D converter 132, the A/D CHANNEL SELECT signal supplied to multiplexer 130, the PRI CKT SEL signal supplied to primary waveform circuit 118, the OPEN CKT KV and OCV RELAY signals supplied to coil test circuit 134, the POWER CHECK signal supplied to power check circuit 126 and the KV PEAK RESET signal supplied to secondary waveform circuit 120. Variable sampling rate circuit 134 produces the CYL CLK signal, which is based upon either the PRI CLOCK or the SEC CLOCK signal and supplies this signal to cylinder counter circuit 136. The CYL CLK signal is also used buy variable sampling rate circuit 134 to determine the period of the primary or secondary waveform. Variable sampling rate circuit 134 supplies this period measurement to microprocessor 48 via engine analyzer bus 142 and master bus 150. Based upon this period measurement, microprocessor 38 selects the desired data sample rate to be used by D/D converter 132, and supplies control signals to variable sampling rate circuit 134 via master bus 150 and engine analyzer bus 142. The data sample rate is controlled by variable sampling rate circuit 134 by means of the A/D CLOCK signal. Variable sampling rate circuit 134 also receives the $\overline{EOC}$ signal from DMA-A/D output buffer 152 and the No. 1 PULSE signal from cylinder counter circuit 136.

In many of the test functions performed by engine analyzer module 52, it is necessary to determine the current cylinder number at various points in time. These engine tests include waveform displays, power check test and timing measurements. Keeping track of cylinder number by using microprocessor 48 becomes inconvenient, particularly when microprocessor 38 is involved in digitizing waveforms, and in reconstructing waveforms for display on raster scan display 14. In the preferred embodiment shown in FIG. 4, cylinder counter circuit 136 performs this cylinder number function. Cylinder counter circuit 136 includes a presettable counter which is loaded with the number of cylinders of the engine under test by data supplied from microprocessor 38 through master bus 50, data bus 150 and engine analyzer bus 142. The number of cylinders of the engine under test is typically supplied to microprocessor 38 through user interface 16.

Cylinder counter circuit 136 counts in response to the CYL CLK signal. The current count of cylinder counter circuit 136 is provided both to the engine analyzer bus 142 and to timing light circuit 138.

The NO. 1 PULSE signal from analog section 52A is supplied to cylinder counter circuit 136. At the beginning of operation of engine analyzer module 52, the first pulse of the NO. 1 PULSE signal presets cylinder counter circuit 136 and thereby synchronizes it to the engine. After that, the No. 1 probe 28 can be removed and the NO. 1 PULSE signal discontinued, and cylinder counter circuit 136 will still remain in synchronization with the engine as long as the CYL CLK signal continues to be supplied. Cylinder counter circuit 136 also is capable of operation without the NO. 1 PULSE signal, and in that case is synchronized to the engine operation by manual inputs supplied by the operator either through use interface 16 or control switches on timing light 20. In this case, the synchronization pulse is supplied through engine analyzer bus 142 to cylinder counter circuit 136, rather than from the NO. 1 PULSE signal.

Timing light circuit 138 controls operation of timing light 20, based upon control signals from microcomputer 48, the cylinder count from cylinder counter circuit 136, and operator input signals supplied from control switches on timing light 20.

In the preferred embodiment shown in FIG. 4, the operation of engine analyzer module 52, under the control of microprocessor 48, is based upon a stored engine analyzer program stored in engine analyzer program memory 140. When the operator selects, through user interface 16, a test function involving engine analyzer module 52, microprocessor 348 interrogates engine analyzer module 52 to determine that it is present in the system, and addresses engine analyzer program memory 140 for the operating instructions required for that particular test. In preferred embodiments of the present invention, each test module such as engine analyzer module 52, exhaust analyzer module 62, and battery/-starter tester module 64 (FIG. 2) has its own associated program memory. As a result, only that memory capacity required for the particular test modules being used is provided.

As discussed previously, transfer of digital data from A/D converter 132 to data memory 56 is provided by DMA controller 58. Digital data from A/D converter 132 is supplied to DMA-A/D output buffer 52. When A/D converter 132 supplies an $\overline{EOC}$ signal to output buffer 152, a DMA request (DMA REQ) signal is supplied by output buffer 52 to master bus 50. DMA converter 58 then takes control of master bus 50 and supplies a DMA acknowledge (DMA ACK) signal to output buffer 152. The digital data from A/D converter 132 is then supplied by output buffer 52 onto master bus 50. DMA controller 58 supplies the addresses to put the individual bytes of data into proper memory locations within data memory 56. DMA controller 58 has the initial address of the first byte of data to be stored (which depends upon the particular test being performed) and the number of bytes of data to be stored. As each byte of data is transferred from output buffer 152 to data memory 56, DMA controller 58 changes the address, and keeps track of the number of bytes which have been stored. When the predetermined number of bytes of data have been transferred, DMA controller 58 relinquishes control of master bus 50 to microprocessor 48, and the data transfer to data memory 56 ceases, even if A/D converter 132 is continuing to sample and convert the particular input signal from multiplexer 130 to digital data.

The present invention displays the waveform for an entire firing cycle of the engine without distorting individual firing waveforms for each cylinder relative to one another and without losing data. During operation of the engine, the total time of the firing cycle changes as the RPM of the engine changes. The total time (Tt) of a firing cycle of the engine is calculated. Tt is the reciprocal of RPM. H is the total number of cylinders in the engine. N is the desired number of data points or samples to be taken for an entire cycle of the engine. Total sampling time is calculated using the following formula:

Equation 1:

$$\text{Sampling Time} = \frac{Tt}{H \times N} \times C$$

In the present invention, C is an adjustment factor which is greater than 1. C is used to increase the total sampling period. This is the same as decreasing the sampling rate. In a preferred embodiment of the present invention, C is 1.1. This extends the total sampling time by ten percent. In other words, a buffer period of ten percent of the expected firing cycle is provided.

In the present invention, the number of data samples, N is maintained constant while the data sampling rate of analog digital converter 132 is varied by variable sampling rate circuit 134 for each firing cycle of the engine to accommodate changes in the engine RPM. Variable sampling rate circuit 134, under the control of microprocessor 48, varies the sampling time as a function of the total time for the engine to complete an entire firing cycle, Tt.

In the present invention, RPM is calculated prior to initiation of data point collection. RPM may be calculated by measuring the time, for the engine to complete an entire firing cycle, or by measuring the time of a single cylinder firing and multiplying by the total number of cylinders. In either case, the measurement provides a predicted value of RPM for the next data sample set. The RPM value is used in Equation 1 to determine the sampling time. The adjustment factor, C, lengthens the sampling time and thereby decreases the rate at which data samples are taken. This allows for variation in the RPM of the engine during the sample period. The digitized data is displayed on display 14. Should the speed of the engine decrease over the sampling period, rather than losing the additional data which would have fallen outside of the sampling window, the present invention provides a buffer period at the end of the sampling period through the use of the adjustment C during which time the engine waveform may be collected and digitized for storage and display. These functions are performed in the engine analyzer digital section 52B.

Figure 5:
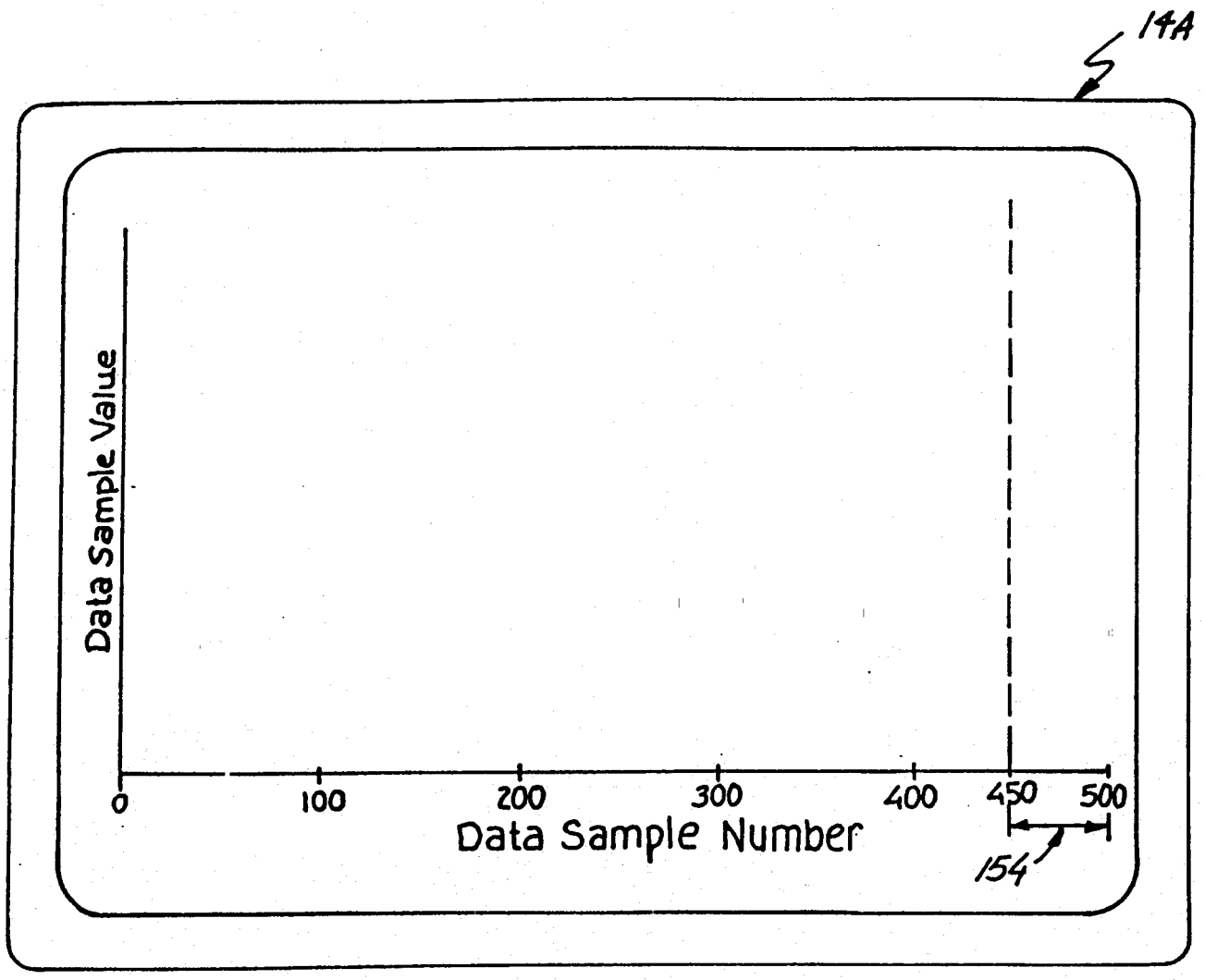
FIG. 5 shows a display for displaying an engine waveform in accordance with the present invention.

Using the present invention, the stored digitized waveform signal is displayed on display 14. Typically, the waveforms for each cylinder are simultaneously displayed on the display in a raster display format. FIG. 5 shows an example of CRT display 14A. In FIG. 5, CRT display 14A shows five hundred sample points along an X axis. In accordance with the present invention, a buffer region 154 of display 14A is provided. Using Equation 1 shown above, the number of data samples N is 450. With the adjustment factor C of 1.1, the number of data samples calculated from Equation 1 is 495 and the buffer period of the sampling period is 45 samples in length. This buffer period corresponds to buffer region 154 on display 14A.

Figure 6:
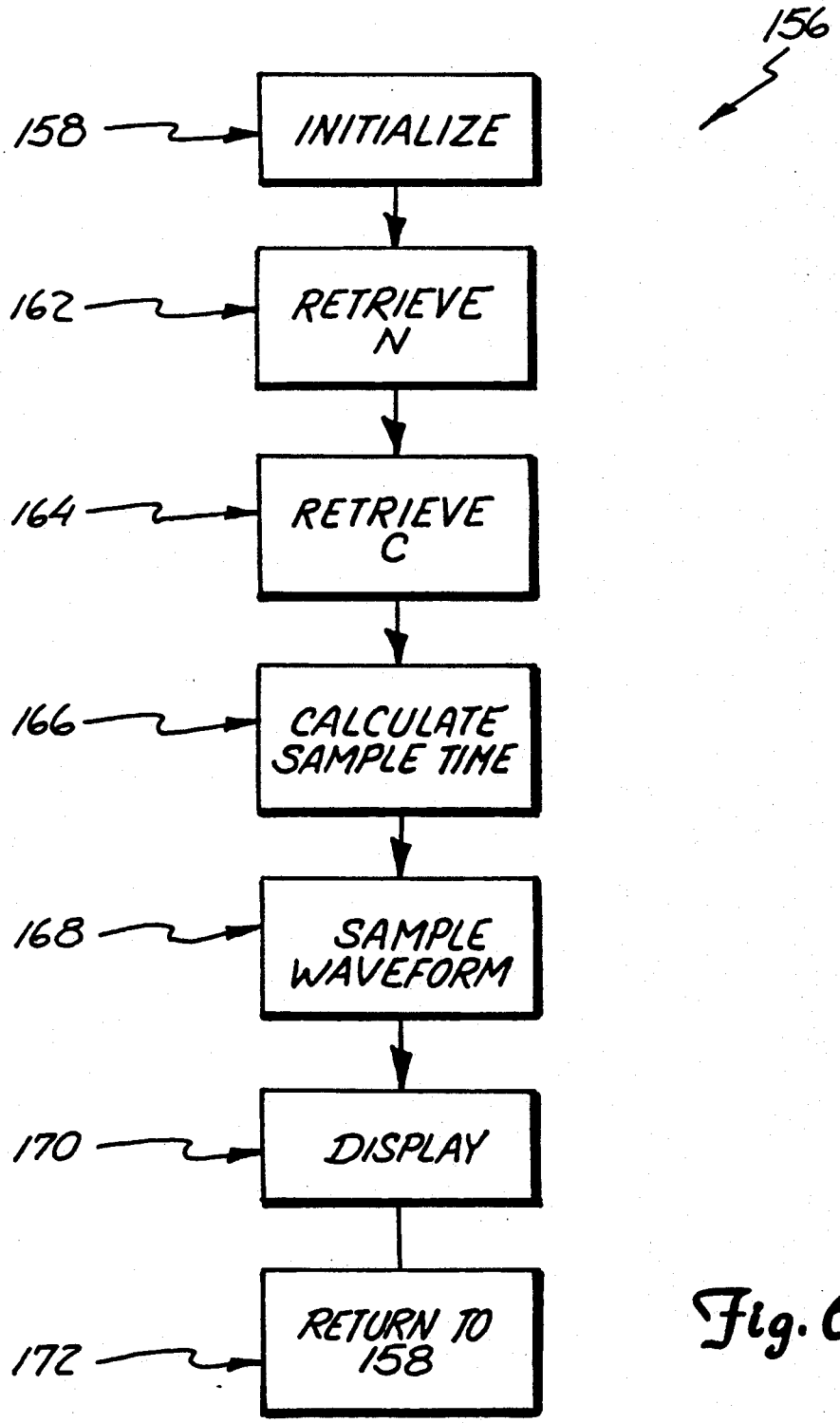
FIG. 6 is a block diagram of steps in accordance with the present invention.

FIG. 6 is a flow chart 156 which shows steps performed by engine analyzer digital section 52B, in accordance with the present invention. Digital section 52B is initialized at initialization block 158. The firing time Tt is measured by digital section 52B at firing time measurement block 160. Digital section 52B retrieves N, the desired number of samples, at block 162. Digital section 52B retrieves the adjustment factor C at block 164. Digital section 52B calculates the sampling time at block 166 using Equation 1. Next, engine analyzer digital section 52B samples the engine waveform at block 168. The sampled information is displayed at block 170 as shown in FIG. 5 on display 14A. Block 172 returns control initialization block 158 and the steps of block diagram 156 are repeated until the measuring process is completed by a technician.

Using the present invention, it is possible to compare cylinder waveforms relative to each other. The waveforms are not distorted relative to one another. Furthermore, if the speed of the engine changes during firing, any additional waveform information, which arises if the time period of a cylinder waveform is extended, is not lost off the edge of the display. The present invention also increases the rate at which cylinder waveforms may be displayed. Each cylinder waveform display requires only a single firing of that cylinder to provide a complete display. Thus, the number of frames per second which can be displayed is increased.

Although the present invention has been described with reference to preferred embodiments, workers skilled in the art will recognize that changes may be made in form and detail without departing from the spirit and scope of the invention. For example, the present invention can be used in either raster or parade type display. Furthermore, the present invention may be used in displaying engine waveforms for any type of ignition system including distributorless ignition systems. In addition, the adjustment factor C may be changed depending upon analyzer and engine characteristics.

What is claimed is:

1. A display, for an engine test system, comprising:

means for providing a periodic analog input waveform representative of operation of an internal combustion engine, the waveform having a period which varies as a function of the engine speed;

analog to digital converter means for sampling the analog input waveform periodically at a data sampling rate and converting each sample to a digital value representative of an analog value of the analog input signal;

display means for displaying a simulated visual representation based upon digital values from the analog to digital converter, the simulated visual display being representative of operation of the internal combustion engine; and means for determining the data sampling rate of the analog to digital converter as a function of engine speed, an adjustment factor, a maximum number of data points, a number of cylinders of the internal combustion engine, and a total firing time of a firing cycle of the internal combustion engine.

2. The display of claim 1 wherein during a firing cycle of the internal combustion engine the data sampling rate provides about ten percent less data samples than the maximum number of data points.

3. The display of claim 1 wherein the display means includes a primary display for displaying the simulated visual representation of a function of the internal combustion engine and a buffer region for displaying portions of the visual representation which exceed boundaries of the primary display region.

4. The display of claim 3 wherein the buffer region has a display capacity which is about ten percent of a display capacity of the primary display region.

5. The display of claim 4 wherein the display capacity of the buffer region is a function of the adjustment factor.

6. A display, for an internal combustion engine, comprising:

means for providing a periodic analog input waveform representative of operation of an internal combustion engine, the waveform having a period which varies as a function of the engine speed;

analog to digital converter means for sampling the analog input waveform periodically at a data sampling rate and converting each sample to a digital value representative of an analog value of the analog input signal;

display means for displaying a simulated visual representation based upon values from the analog to digital converter, the simulated visual display being representative of a function of the internal combustion engine, the display means including a primary display region for displaying the function of the internal combustion engine, the primary display region having display boundaries, and a buffer display region for displaying portions of the simulated visual display which exceed the display boundaries of the primary display region; and means for determining the data sampling rate of the analog to digital converter as a function of engine speed, a maximum number of data points, a number of cylinders of the internal combustion engine, a total firing time of a firing cycle of the internal combustion engine and an adjustment factor.

7. The display of claim 6 wherein during a firing cycle of the internal combustion engine the data sampling rate provides about ten percent less data samples than the maximum number of data samples.

8. The display of claim 6 wherein the buffer display region has a display capacity which is about ten percent of a display capacity of the primary display region.

9. The display of claim 7 wherein the display capacity of the buffer display region is a function of an adjustment factor used to adjust the data sampling rate.

10. A method of sampling data, in an internal combustion engine testing system, comprising:

measuring a firing time of a cylinder of an internal combustion engine;

calculating a sampling time based upon the firing time, a predetermined number of data samples to be taken and a buffer period;

measuring a periodic analog waveform representative of operation of the internal combustion engine;

converting the analog waveform to a digital waveform at a sampling rate determined by the sampling time period; and displaying a visual display representative of a function of the internal combustion engine based upon the digital waveform wherein the buffer period provides a buffer region in the display and the buffer region is about ten percent of the predetermined number of data samples, to accommodate variation in a total firing time of a cylinder.

11. The method of claim 10 wherein calculating a sampling time period comprises dividing a time period of a firing cycle of the internal combustion engine by a number of cylinders in the engine and a predetermined number of data points and multiplying by an adjustment factor.

12. A display, for an engine test system, comprising:

means for providing a periodic analog input waveform representative of operation of an internal combustion engine, the waveform having a period which varies as a function of the engine speed;

analog to digital converter means for sampling the analog input waveform periodically at a data sampling rate and converting each sample to a digital value representative of an analog value of the analog input signal;

display means for displaying a simulated visual representation based upon digital values from the analog to digital converter, the simulated visual display being representative of operation of the internal combustion engine, including a primary display for displaying the simulated visual representation as a function of the internal combustion engine and a buffer region for displaying portions of the visual representation which exceed boundaries of the primary display region; and means for determining the data sampling rate of the analog to digital converter as a function of engine speed and an adjustment factor.

13. The display of claim 12 wherein the means for determining the data sampling rate comprises means for determining the data sampling rate as a function of a maximum number of data points, a number of cylinders of the internal combustion engine, a total firing time of a firing cycle of the internal combustion engine and the adjustment factor.

14. The display of claim 13 wherein during a firing cycle of the internal combustion engine the data sampling rate provides about ten percent less data samples than the maximum number of data points.

15. The display of claim 12 wherein the buffer region has a display capacity which is about ten percent of a display capacity of the primary display region.

16. The display of claim 15 wherein the display capacity of the buffer region is a function of the adjustment factor.

17. A display for an internal combustion engine, comprising:

means for providing a periodic analog input waveform representative of operation of an internal combustion engine, the waveform having a period which varies as a function of the engine speed;

analog to digital converter means for sampling the analog input waveform periodically at a data sampling rate and converting each sample to a digital value representative of an analog value of the analog input signal;

display means for displaying a simulated visual representation based upon values from the analog to digital converter, the simulated visual display being representative of a function of the internal combustion engine, the display means including a primary display region for displaying the function of the internal combustion engine, the primary display region having display boundaries, and a buffer display region for displaying portions of the simulated visual display which exceed the display boundaries of the primary display region wherein the buffer display region has a display capacity which is about ten percent of a display capacity of the primary display region; and means for determining the data sampling rate of the analog to digital converter as a function of engine speed.

18. The display of claim 17 wherein the means for determining the date sampling rate comprises means for determining the data sampling rate as a function of a maximum number of data points, a number of cylinders of the internal combustion engine, a total firing time of a firing cycle of the internal combustion engine and an adjustment factor.

19. The display of claim 18 wherein during a firing cycle of the internal combustion engine the data sampling rate provides about ten percent less data samples than the maximum number of data points.

20. The display of claim 17 wherein the display capacity of the buffer display region is a function of an adjustment factor used to adjust the data sampling rate.

21. A method of sampling data, in an internal combustion engine testing system, comprising:

measuring a firing time of a cylinder of an internal combustion engine;

calculating a sampling time period by dividing a time period of a firing cycle of the internal combustion engine by a number of cylinders in the engine and a predetermined number of data points and multiplying by an adjustment factor;

measuring a periodic analog waveform representative of operation of the internal combustion engine;

converting the analog waveform to a digital waveform at a sampling rate determined by the sampling time period; and displaying a visual display representative of a function of the internal combustion engine based upon the digital waveform wherein the buffer period provides a buffer region in the display, to accommodate variation in a total firing time of a cylinder.

22. The method of claim 21 wherein the buffer region is about ten percent of the predetermined number of data samples.

* * * * *